United States Patent [19]

Crener

[11] 4,274,847

[45] Jun. 23, 1981

[54] VACUUM CLEANER DUST BAG

[75] Inventor: Bengt O. Crener, Amal, Sweden

[73] Assignee: Aktiebolaget Electrolux, Stockholm, Sweden

[21] Appl. No.: 73,028

[22] Filed: Sep. 6, 1979

[30] Foreign Application Priority Data

Sep. 25, 0978 [SE] Sweden ..... 7810013

[51] Int. Cl.[3] ..... B01D 46/02

[52] U.S. Cl. ..... 55/374; 55/378; 55/381; 55/DIG. 2; 229/62.5

[58] Field of Search ..... 55/374–378, 55/381, DIG. 2; 229/62.5

[56] References Cited

U.S. PATENT DOCUMENTS

| | | | |
|---|---|---|---|
| 2,868,321 | 1/1959 | Kelly | 55/376 X |
| 3,137,023 | 6/1964 | Klinge et al. | 55/377 UX |
| 3,150,405 | 9/1964 | Tissler | 55/374 X |
| 3,675,399 | 7/1972 | Westergren | 55/377 X |

*Primary Examiner*—Kathleen J. Prunner
*Attorney, Agent, or Firm*—Alfred E. Miller

[57] ABSTRACT

A vacuum cleaner dust bag with a relatively rigid collar having an inlet opening for an inlet tube connected to a vacuum cleaner housing. The opening is covered by an apertured elastic diaphragm. The opening of the dust bag is further provided with a large zone and a small zone, which are integral, so that the inlet tube can be inserted through the large zone and the dust bag displaced laterally so that a peripheral flange on the inlet tube will engage with surrounding portions of the diaphragm aperture disposed in the small zone. The dust bag is moved to and retained in this position by the elastic diaphragm whose aperture is disposed centrally relative to said small zone.

3 Claims, 7 Drawing Figures

VACUUM CLEANER DUST BAG

BACKGROUND OF THE INVENTION

This invention relates to a vacuum cleaner dust bag comprising a collar of relatively rigid material and a dust container, fixed or detachably connected to the collar, which has an opening for an inlet tube of a vacuum cleaner hose, which conveys dust from the vacuum cleaner hose to its dust container, the opening being at least partly covered by an elastic diaphragm or the like having an aperture.

Dust bags of the above type are known. In these bags the object of the diaphragm is in the first place to close the opening so that dust collected in the bag will not escape from the bag when taken out of the vacuum cleaner. Another object of the diaphragm is to seal around the inlet tube, so that no air will leak around the inlet tube. Problems have arisen in the past in vacuum cleaners not having supporting plates for the collars of the known dust bags used therewith. Thus, the diaphragm of the known dust bag is not always capable of maintaining the collar on the inlet tube when the weight of the dust bag increases, after a certain period of use. When the bag has become detached from the inlet tube the dust and dirt therein will enter into the vacuum cleaner at the side of the bag.

The object of the present invention is to eliminate the above drawback, and to provide a dust bag which is safely retained to the inlet tube during the operation of the vacuum cleaner.

The above object of the invention is achieved in a dust bag wherein the shape of the opening is such that the inlet tube and a substantially nonresilient peripheral flange thereon, or a substantially nonresilient shoulder or shoulders on the inlet tube, can be moved through the opening without being significantly hindered by the surrounding collar. Furthermore, the collar, by being moved laterally or turned, can be brought to assume a blocking position in which the flange, shoulder or shoulders of the inlet tube prevents axial displacement of the collar.

An embodiment of the invention will now be described with reference to the accompanying drawings in which.

DESCRIPTION OF THE PREFERRED EMBODIMENT

Figure 1:
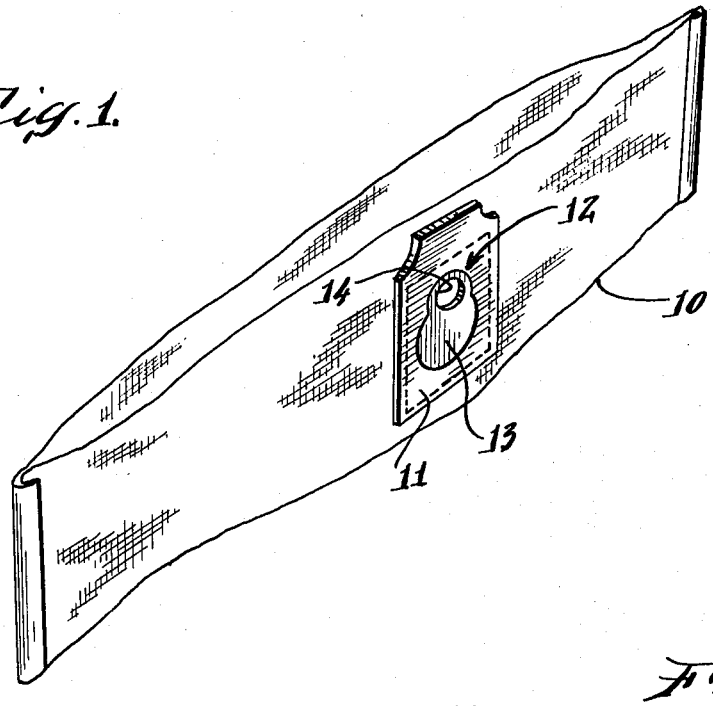
FIG. 1 is a perspective view of a vacuum cleaner dust bag constructed in accordance with the teachings of the present invention.
Figure 2:
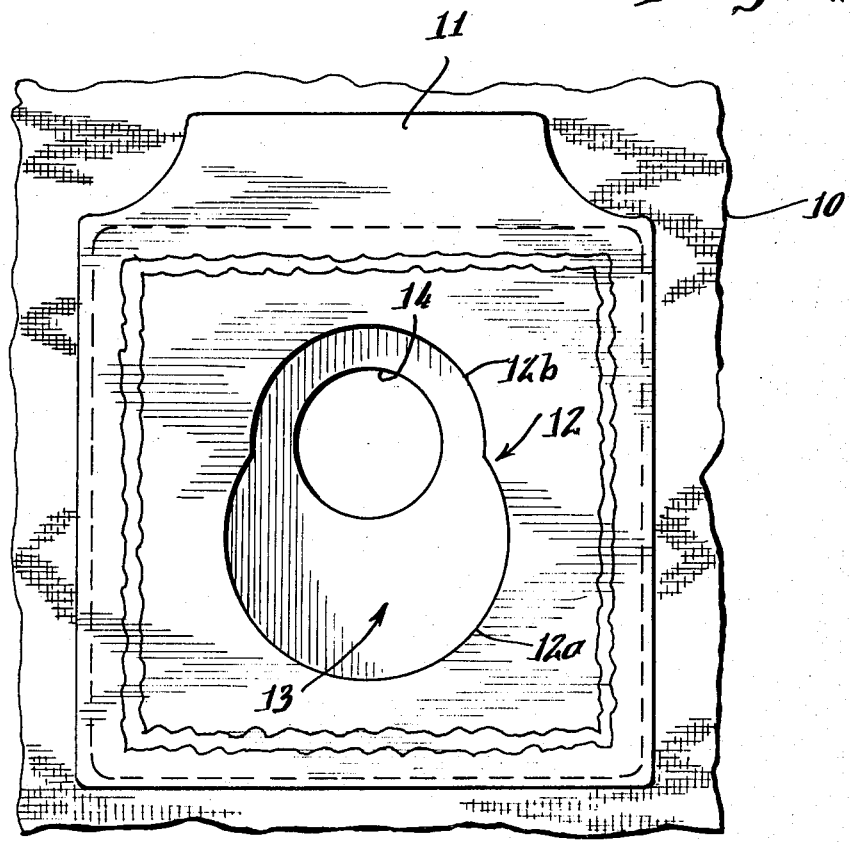
FIG. 2 is a front elevational view, drawn on an enlarged scale, of the collar of the dust bag.

The dust bag shown in FIG. 1 comprises a dust container of air-permeable material, for example paper or cloth, and has a collar 11 with an inlet opening into the bag. The collar is fabricated of a relatively rigid material, such as cardboard or plastic, and can be fixed or detachably connected to the container 10.

The dust bag collar is provided with a central opening 12 formed by a zone 12*a* merging into an integral smaller zone 12*b*. The major part of the opening 12 is covered by an elastic, thin diaphragm 13 with an aperture 14 for an inlet tube 15, which forms a continuation of the vacuum cleaner hose (not shown) and has a peripheral flange 16. The diaphragm, and if desired also the container, is secured to the collar around the opening 12, for example by glue or any other suitable means. The aperture 14 of the diaphragm is so disposed that it lies substantially inside the zone 12*b* having a small extension. The opening 12 is in a circular form with a cut segment, and having a diameter such that the inlet tube 15 with the flange 16 can be freely moved through the opening. Also the zone 12*b* is in the form of a circle with cut segment, the diameter of this circle being less than the outer diameter of the flange 16.

Figure 3:
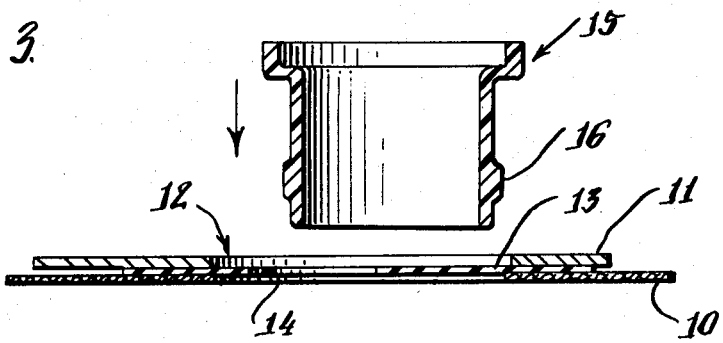
FIGS. 3–7 are sectional views of various positions of the dust bag upon insertion in and removal out of the vacuum cleaner.
Figure 4:
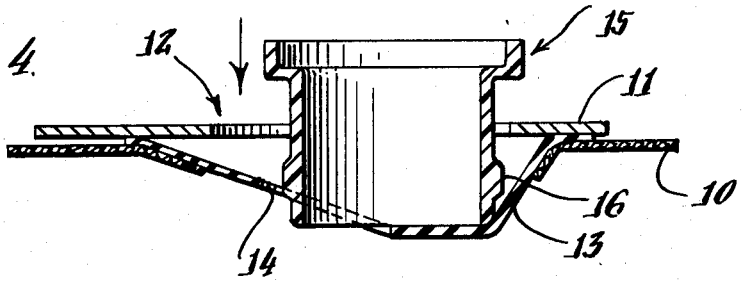
Figure 5:
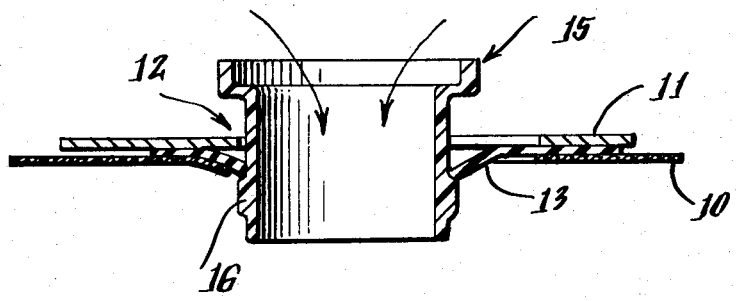
Figure 6:
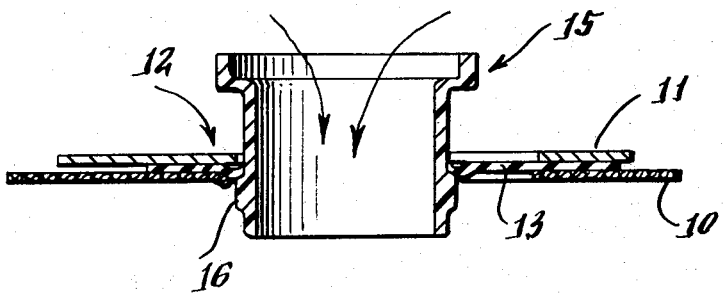

The dust bag is employed in the following manner: The dust bag is placed in the vacuum cleaner and the inlet tube 15 is moved into the opening 12 in the zone 12*a* (FIG. 3). Thus, the diaphragm 13 will be stretched (FIG. 4) and the diaphragm portions surrounding the aperture 14 are fitted over the flange 16 of the inlet tube at the same time as the collar, by means of the spring force of the diaphragm, is moved to the right, as shown in FIGS. 4 and 5. This means that the zone 12*b* of small extension will enclose the inlet tube and prevent the flange from moving out of the opening 12 because the peripheral edge surrounding the aperture 14 has a smaller diameter than the outer diameter of the flange 16. As the bag is being filled with dust, the collar assumes the position of FIG. 6 in which it abuts the diaphragm, and which also presses against the flange 16.

Figure 7:
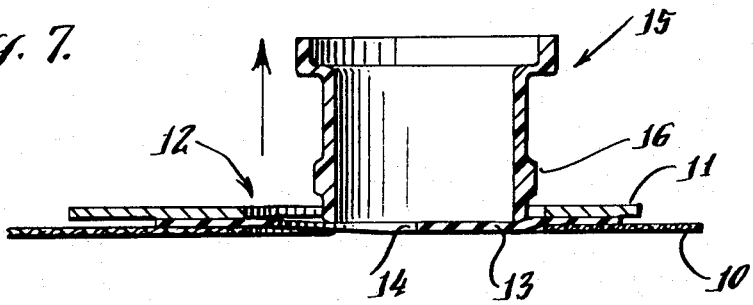

To remove the dust bag, the inlet tube 15 is lifted, the bag following with it. Moving the bag to the left in the Figures causes the large zone 12*a* of the opening 12 to be coaxial with the inlet tube, which means that the inlet tube can be drawn out of the opening and the diaphragm can return to its original position (FIG. 7).

It should be evident that the opening 12 must not necessarily have the form as shown in the drawings. What is necessary is only that the inlet tube with the flange can be moved through the opening and then to the side so that the flange will engage the collar. It is also possible, within the scope of the present invention to form the opening such that peripheral shoulders of the inlet tube can be inserted through cuts, corresponding to the shoulders, in the edge of the opening and to secure the collar to the inlet tube by turning the collar.

It is considered that the present invention is not limited to the embodiment shown and described herein, but may be modified within the spirit of the scope of the following claims.

What is claimed is:

1. A vacuum cleaner dust bag having a container and a collar of relatively rigid material and adaptable to be connected to an inlet tube of a vacuum cleaner hose, said collar having an opening and comprising: an elastic diaphragm covering said opening on said collar and having an aperture therein forming an opening for said inlet tube which conveys dust from said vacuum cleaner hose to said dust bag, the opening in said collar having a shape such that the inlet tube having a pheripheral flange thereon can be moved through the aperture in said diaphragm without being significantly hindered by said surrounding collar and said collar can be moved laterally so that a portion of its opening which has a diameter that is smaller than the diameter of said peripheral flange engages the flange of the inlet tube and prevents axial displacement of said collar, said opening in said collar comprises a first zone into which the inlet tube is to be inserted and which merges into said portion which is a second zone of smaller proportion, the diaphragm in the second zone being retained on said inlet tube when said collar is moved laterally towards said second zone, and said diaphragm opening is so positioned that the major part of the area of the opening is in said second zone.

2. A vacuum cleaner dust bag as claimed in claim 1 wherein said zones are circularly shaped and partially overlapping, and wherein the diameter of one circle is greater than the diamter of the other circle.

3. A vacuum cleaner dust bag as claimed in claim 1 wherein said peripheral flange on said inlet tube is substantially circular and is adapted to fit within the aperture in the diaphragm, said opening in said diaphragm being circular and of a diameter that is slightly less than the outside diameter of said peripheral flange.

* * * * *